US006664896B2

(12) United States Patent
McDonald et al.

(10) Patent No.: US 6,664,896 B2
(45) Date of Patent: Dec. 16, 2003

(54) ARTICLE LOCATING DEVICE USING POSITION LOCATION

(76) Inventors: Jill Elizabeth McDonald, 6482 Ambrosia Dr., #5212, San Diego, CA (US) 92124; Scott Clifford Harris, P.O. Box 1389, Rancho Santa Fe, CA (US) 92067

( * ) Notice: Subject to any disclaimer, the term of this patent is extended or adjusted under 35 U.S.C. 154(b) by 0 days.

(21) Appl. No.: 09/682,731

(22) Filed: Oct. 11, 2001

(65) Prior Publication Data

US 2003/0071728 A1 Apr. 17, 2003

(51) Int. Cl.[7] ..... G08B 13/14

(52) U.S. Cl. ..... 340/572.1; 340/572.8; 340/825.36; 340/825.49

(58) Field of Search ..... 340/572.1, 572.8, 340/573.1, 825.36, 825.49, 10.1

(56) References Cited

U.S. PATENT DOCUMENTS 5,596,313 A * 1/1997 Berglund et al. ..... 340/574
5,652,570 A * 7/1997 Lepkofker ..... 340/573.1
5,677,673 A * 10/1997 Kipnis ..... 340/539
5,680,105 A * 10/1997 Hedrick ..... 340/571
5,926,090 A * 7/1999 Taylor et al. ..... 340/568.1
5,939,981 A * 8/1999 Renney ..... 340/539
6,031,460 A * 2/2000 Banks ..... 340/573.1
6,133,832 A * 10/2000 Winder et al. ..... 340/572.1
6,166,652 A * 12/2000 Benvenuti ..... 340/825.49
6,317,049 B1 * 11/2001 Toubia et al. ..... 340/573.4
6,366,202 B1 * 4/2002 Rosenthal ..... 340/539

* cited by examiner

*Primary Examiner*—Toan N Pham

(57) ABSTRACT

A lost article finding device, which can be used for, for example, finding keys and the like. The finding device has a element for automatically finding its location, such as a GPS device or other position detecting device. A transceiver receives requests from a remote location, and response to those requests. The requests may include periodic pings, which are simply sent to ensure that the device is responding to requests. The requests may also include specialized requests which specifically request the device to report its current location.

11 Claims, 3 Drawing Sheets

ARTICLE LOCATING DEVICE USING POSITION LOCATION

BACKGROUND OF INVENTION

Identification and security devices are often kept small for convenience. Examples of such devices may include access cards and keys. The small size of these devices correspondingly means that it becomes easier to lose them. People commonly lose their keys and other such items. This may be serious, since without keys, an owner might not be able to operate their vehicles or enter their place of business.

Article finding systems are known in which a sound producing device is attached to the article to be found, e.g. the keychain. A separate remote device is actuated to cause the sound producing device to make noise. When the article finding device receives the special signal from the remote, it starts emitting its characteristic sound, thereby signaling its location.

This system may work so long as 1) the article is within earshot when the remote is pressed, 2) the owner can find the special remote, and 3) the article is within range of the remote. This seriously limits the use of such a system. For example, if the lost keys are under a pile of clothes, the user may not be able to hear the signaling sound. Moreover, if the user does not even have an idea of the geographical area of their keys (e.g. what room, what building, or the like,), then the system will not be able to find the keys, unless the remote happens to be in the same room as the keys.

SUMMARY OF INVENTION

The present application teaches a system in which a device may be associated with an article and is subsequently usable to find the location of the article. The embodiments describe a system which uses an electronic position detection location device along with a transceiver. The user can access the position from a publicly available network, e.g., a 'client' that is connected to an information server, such as a Web server or web service.

The client may be used to access the main system running on the server, and to request the position of the article by sending a request to position location detection device. That device has a transceiver which can receive these transmissions and also create transmissions back to the server which may be sent, correspondingly, to the client. Upon receiving a request, the transceiver determines its current position and reports information indicative of that current position. The position is then sent to the requesting client. The client can guide the user from their current location to the position of the article.

BRIEF DESCRIPTION OF DRAWINGS

These and other aspects will now be described in detail with reference to the accompanying drawings, wherein.

DETAILED DESCRIPTION

Figure 1:
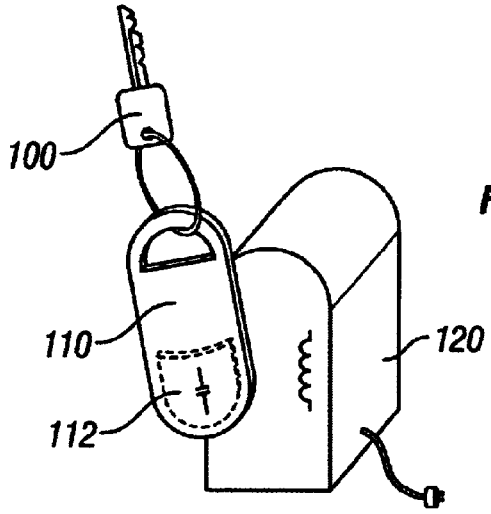
FIG. 1 shows a basic diagram of the article finding system with keys attached, located on a cradle used to recharge its rechargeable battery.

FIG. 1 shows a basic diagram of the system when applied to a lost key finding device. The article in FIG. 1 includes at least one key 100 which is connected, as conventional, to a key chain device here shown as 110. The key chain device has a rechargeable power source, here battery 112, therein. The rechargeable battery is preferably a battery without a memory effect, e.g. nickel metal hydride, or lithium ion type battery.

In this embodiment, the cradle 120 holds the key chain device and includes a non contact mechanism for recharging the battery using an inductive technique or the like. As an alternative, there can be contacts on the exterior of the key chain device, which come into contact with corresponding contacts on the cradle. The cradle is used to maintain the battery 112 at full charge level. As will be explained herein, the effectiveness of this system relies on the battery having sufficient charge to operate in the desired way. Therefore, certain advantages may be obtained by using a cradle that holds the key chain and also charges it at any given time.

While this application describes the power source being a battery, any other portable source of power could alternatively be used, e.g., a fuel cell.

Figure 2:
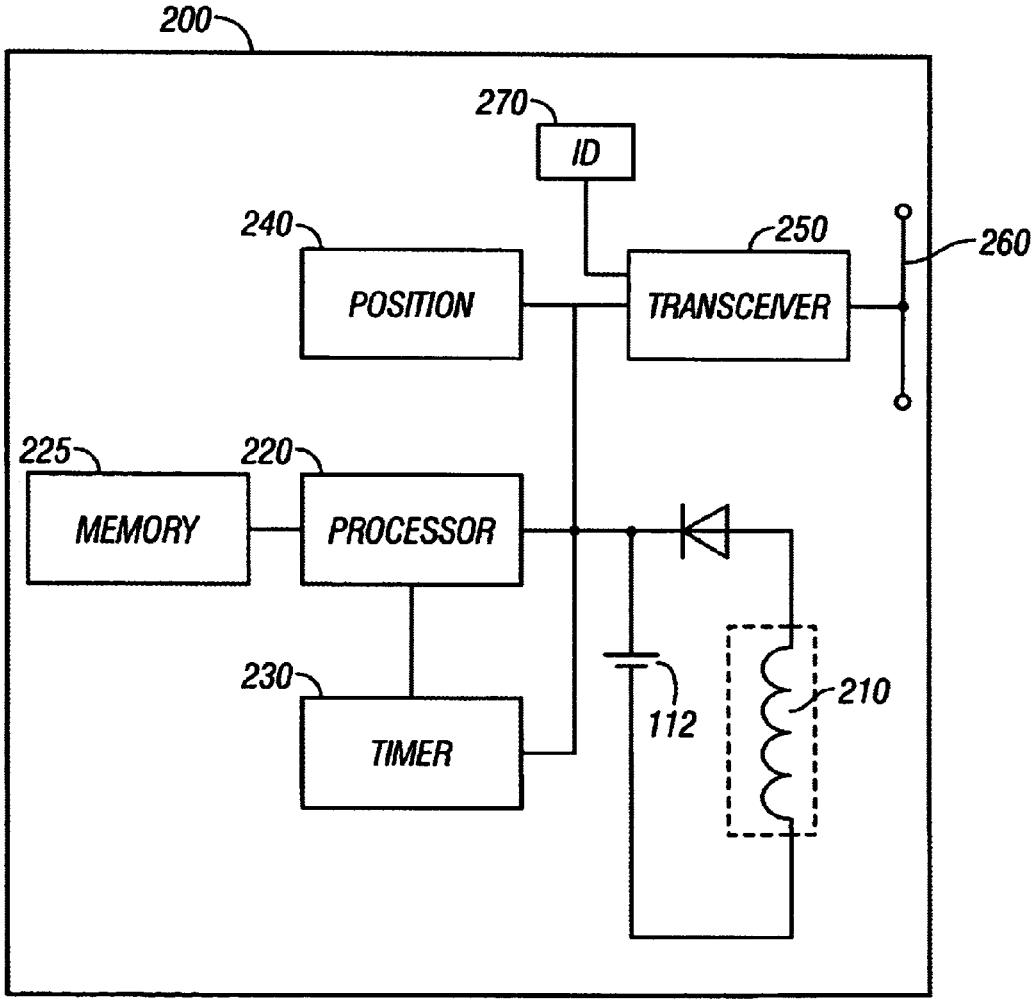
FIG. 2 shows a block diagram of the lost article finding system.

A block diagram of the electronics in the key chain device is shown in FIG. 2. A housing 200, which may be plastic or any desired material, holds the various electronic structure. A battery charging device 210 may be an inductor coil which receives applied resonant radiation in order to charge the battery 112. As explained previously, an alternative system may simply use electronic contacts on an exterior of the housing 200.

A processor 220 runs a stored program according to stored instructions in a memory 225. A hardware based timer 230 is also provided which controls the sleep state of the processor 220 and the other associated hardware. In operation, most of the time, all of the hardware is maintained in a reduced power, or "sleep" state. This is done to reduce the power constraints of the battery 112, thereby allowing the battery 112 to operate the circuitry when needed.

A position detecting device 240 may be any of a number of conventional position detecting devices. It may include a global positioning or GPS receiver, however this may have certain limitations due to the difficulty of receiving GPS signals in certain environments. It may be a so-called enhanced GPS receiver, which uses GPS that is enhanced using radio signals, such as cellular telephone signals. It may also be a so-called local positioning system or LPS, such as described in http://www.syptech.com/applications/applications.html. Any other positioning system which automatically determines a current position may also be used.

Alternatively, the position detecting element 240 may include an element that detects some aspect of the environment, such as a camera or the like.

The output of the position detecting device 240 is coupled to a transmitter/receiver device 250 which is connected to an antenna 260. The antenna may be external to the device.

Figure 3:
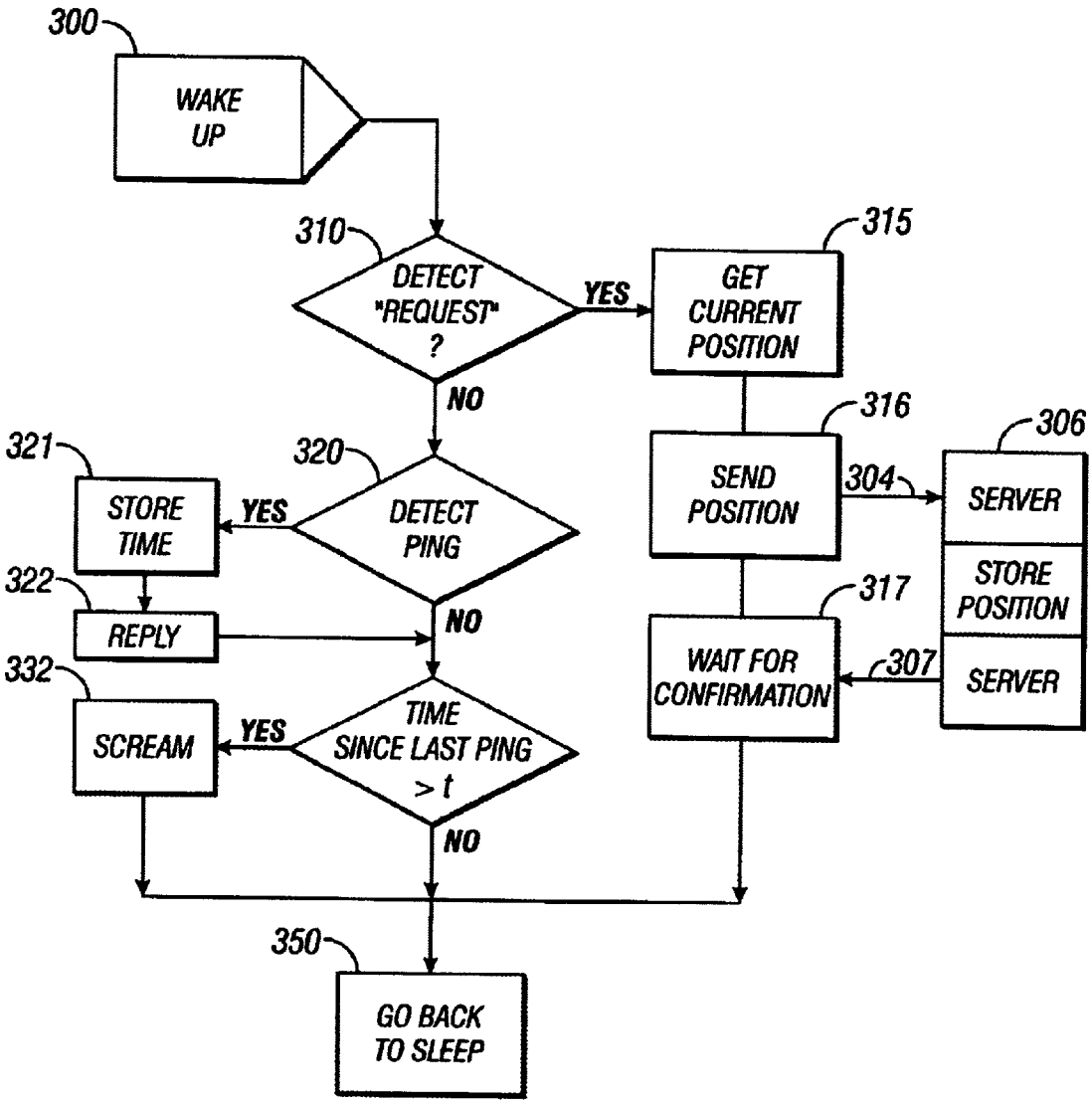
FIG. 3 shows a flowchart of operation of the structure of the lost article finding system.

Antenna 260 may also receive signals which are sent globally and associated with the specific device. Transceiver 250 includes a unique device address ID shown as 270, associated therewith. For example, the unique device address ID may be stored in a special register or read-only memory on or associated with the unit. Any transmissions will include the unique ID. Moreover, any receptions will be received and processed only when they include either the ID, or a special global information ID that indicates all devices. The kinds of signals that are received are described herein. The processor 220 may operate on the signals according to the flowchart of FIG. 3.

In operation, the watchdog time circuit may maintain the circuitry within the keychain device in a "sleep" state, as conventional. Element 300 represents wake-up of the circuitry, which is carried out by the watchdog device 230. When the circuitry first wakes up, it detects monitors the transceiver for transmissions. To the different kinds of transmissions can be received: said referred to herein as pings and requests being received by the transceiver 250. At 310, the system detects a "request". A request is a signal sent by the server to the lost article locating device, requesting that the device report its specific position. This can occur when a user logs in to a client device, and commands location determination of the keychain device. The command for keychain location will cause a request to be sent to the specific keychain device.

If a request is detected at 310, then the keychain device gets its current position at 315, which is obtained from the position circuit 240, in any conventional way. The information indicative of position is sent by the transceiver at 316. 304 represents the sending of the position to the server who receives the position at 306 and stores the most recent position. This most recently stored position may be used indicates that the keychain device does not respond to her request. After storing the position, the server sends a confirmation at 307.

The keychain system waits for confirmation from the server at 317.

After receiving a confirmation from the server, the system is put back to sleep at 350, by actuating the watchdog timer 230 to put all associated circuitry back to sleep.

If no "request" has been received at 310, then 320 operates to detect a "ping". A "ping" is a signal which is sent periodically from the server to the device, to make sure that the device receives the signal and is in a condition (e.g., position, battery state, etc) to respond. When a ping is received, the device first stores the time of the ping at 321. In response to the ping, at 322, the device sends an indication that the ping has been well-received, and an indication of the device's unique ID. At this point, the circuitry can again go back into the sleep mode.

If no ping is detected at 320, then the time since the last ping is detected at 330. Specifically, 330 detects if the time since the last ping is greater than a specified time t, which is defined as an alarm time. For example, if the ping is sent by the server every two hours, then a local alarm in the keychain device may be established if no ping has been received by the device in eight hours. This alarm causes the device to enter "scream" mode at 332. Different techniques of effecting the scream mode may be used. In one embodiment, the transmitter is capable of transmitting at multiple different power levels. Scream mode may cause the transmitter to transmit at higher power levels then in the other modes. In another mode, special reserve battery power (e.g. a separate battery cell for example) is maintained and used only in scream mode.

More generally, however, in scream mode, the device carries out operations which make it more likely that the server will receive responses from the keychain device. For example, in scream mode, the device may increase its transmission power and immediately send an indication of its location. Scream mode may also allow the device to access its reserve power. This makes it more likely that the location of the device can be received and processed. Again, it is important that battery life is maintained. Therefore, after screen mode is entered, the device may still go back to sleep at 350.

Figure 4:
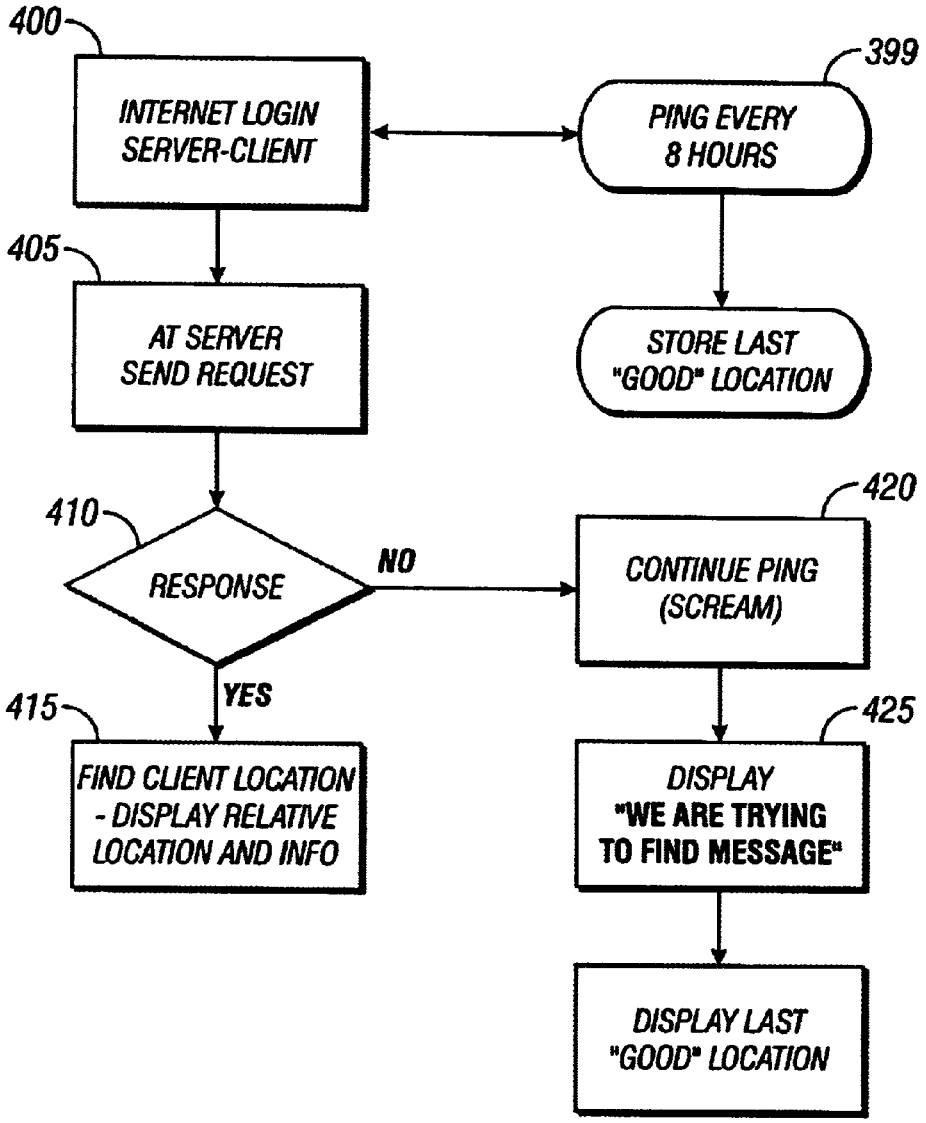
FIG. 4 shows a flowchart of the Internet server operation.

When the user wants to find their lost articles, the process is initiated by logging into the server via some terminal. FIG. 4 shows the login being via the Internet, however it should be understood that other forms of login to the server may be used.

At 400, the user logs in to the server over the Internet by entering their user ID and password. The server is also shown carrying out a "ping" every specified amount of time, e.g. every two hours. The server monitors to determine whether it receives responses to these pings. When responses are received, it means, of course, that the article finding system has received the "ping", has sufficient battery power to respond, has responded, and the conditions are such that the transmission is received by the server. When responses are not received, it means that any of these things are not operating correctly. The system may take certain actions in response, e.g., may request the scream mode.

After the user logs in at 400, the user may send a request at 405, to the article finder, requesting a position report. A response to this request for position report may be received at 410.

In the usual case, the article finder responds by getting and sending its current position. The response is detected at 410. At 415, the system finds the current location of the client from which the user is requesting location information, and displays the information, including relative location.

The client location may be found by IP address or other automated techniques. As an alternative, the server may simply ask the client where it is located. After obtaining the client location, and obtaining the automatic location of the lost object, the system can determine the distance and direction to the client location. If the object is further than a specified distance, the system may also display a map of how to get there.

At 410, if no response is received, the system continues the ping, shown as 420. This continuing ping may also include instructions asking the device to go into scream mode, so that information from the article finding device can be more easily received. At 425, the system may then display a message indicating that it is trying to find the lost article finding device.

Although only a few embodiments have been disclosed in detail above, other modifications are possible.

What is claimed is:

1. A keychain device comprising:

a keychain part, including a part for holding keys and including a housing;

a source of power in said housing:

a sleep mode controlling device, operating to maintain associated circuitry in a sleep mode during certain modes of operation in which power consumption from the source of power is minimized;

a position detecting device, powered by said source of power and operable responsive to said sleep mode controlling device, operating to detect a current position when requested and enabled by said sleep mode controlling of said using and keychain device; and a communication device, receiving information from said position detecting device, powered by said source of power, and operating responsive to said sleep mode controlling device, and operating to report said information from said position detecting device to a remote object during the time when said sleep mode controlling device is not maintaining said circuitry in said sleep mode, and when requested by said remote device.

2. A device as in claim 1, wherein said source of power includes a rechargeable battery.

3. A device as in claim 1, wherein said position detecting device includes a receiver for receiving global positioning signals.

4. A device as in claim 1, further comprising an address register, storing information which uniquely identifies said device.

5. A device as in claim 4, further comprising a multiple power level control associated with said communication device, which causes said communication device to transmit at a first level in a first mode, and to transmit at a second higher power level in response to a predetermined stimulus.

6. A keychain device as in claim 1, wherein said sleep mode controlling device maintains said position detecting device in the sleep mode and awakens said position detecting device from said sleep mode responsive to a request by said remote device.

7. A lost article finding device, comprising:

a source of power;

a position detecting device, powered by said source of power, and operable to determine a current position;

a timer device, maintaining a count of time since transmissions of a specified type have been received; and a transceiver device, operating responsive to a request for position, to send information from said position detecting device, and operable responsive to said timer device, to operate in a second mode of operation, in which it is more likely that the user will receive said information responsive to said request for position, responsive to no transmissions of the specified type having been received for a specified time.

8. A device as in claim 7, wherein said second mode of operation causes transmissions by said transceiver device at a higher power than said first mode of operation.

9. A device as in claim 7, wherein said second mode of operation allows operation from an additional source of power beyond that allotted in said first mode of operation.

10. A device as in claim 7, further comprising a memory storing information indicative of a last known position of said device.

11. A device as in claim 7, further comprising a keychain associated with said device, for holding a plurality of keys and locating said plurality of keys.

* * * * *